US006675618B2

(12) United States Patent
Matsuzaki

(10) Patent No.: US 6,675,618 B2
(45) Date of Patent: Jan. 13, 2004

(54) METHOD FOR MANUFACTURING HEAT TRANSFER MEMBER

(75) Inventor: Toyoaki Matsuzaki, Shizuoka-ken (JP)

(73) Assignee: Xenesys Inc. (JP)

( * ) Notice: Subject to any disclaimer, the term of this patent is extended or adjusted under 35 U.S.C. 154(b) by 56 days.

(21) Appl. No.: 10/053,702

(22) Filed: Jan. 24, 2002

(65) Prior Publication Data

US 2003/0136170 A1 Jul. 24, 2003

(51) Int. Cl.[7] ..... B21D 43/02
(52) U.S. Cl. ..... 72/16.2; 72/385; 72/404
(58) Field of Search ..... 72/15.3, 16.2, 72/17.3, 404, 385, 384

(56) References Cited

U.S. PATENT DOCUMENTS

| | | | | |
|---|---|---|---|---|
| 3,196,818 A | * | 7/1965 | Sune | 72/379.2 |
| 3,228,367 A | | 1/1966 | Donaldson | |
| 4,250,728 A | * | 2/1981 | King | 72/177 |
| 4,434,643 A | * | 3/1984 | Almqvist et al. | 72/379.6 |
| 4,736,610 A | * | 4/1988 | Carroll et al. | 72/325 |
| 4,819,473 A | * | 4/1989 | Jansen | 72/382 |
| 4,835,805 A | * | 6/1989 | Gray | 72/31.1 |
| 5,417,097 A | * | 5/1995 | Kojima et al. | 72/335 |
| 5,697,246 A | * | 12/1997 | Kuroda et al. | 72/356 |
| 5,791,186 A | * | 8/1998 | Nishida et al. | 72/337 |
| 5,970,774 A | * | 10/1999 | Burgess et al. | 72/294 |

FOREIGN PATENT DOCUMENTS

| | | |
|---|---|---|
| JP | 58-077718 A1 | 5/1983 |
| JP | 03-099735 A1 | 4/1991 |
| JP | 2002-035871 A1 | 2/2002 |

* cited by examiner

*Primary Examiner*—Daniel C. Crane
(74) *Attorney, Agent, or Firm*—Rader, Fishman & Grauer PLLC

(57) ABSTRACT

A method for manufacturing a heat transfer member comprises the step of subjecting material to be worked, which is made of a metallic thin sheet, to a press forming utilizing upper and lower molds of a press-forming devices to form the material to be worked into a shape having prescribed irregularities, thereby preparing a heat transfer member for a heat exchanger. An elongated material is used as the material to be worked. A press-forming device is provided with molds each having a length shorter than the elongated material to be worked. The press forming is carried out by press-forming, while feeding the elongated material to be worked in a single feeding direction in parallel with a longitudinal direction of the elongated material to be worked, the elongated material to be worked on prescribed portions thereof, which have been previously set so as to be placed at prescribed intervals in the longitudinal direction of the elongated material to be worked, utilizing the press-forming device, thereby preparing the heat transfer member having a plurality of patterns of irregularities, which are arranged in the longitudinal direction of the elongated material to be worked.

16 Claims, 11 Drawing Sheets

METHOD FOR MANUFACTURING HEAT TRANSFER MEMBER

BACKGROUND OF THE INVENTION

1. Field of the Invention

The present invention relates a method for manufacturing a heat transfer member for a heat exchanger by press forming a material to be worked, and specifically to a method for manufacturing the heat transfer member by subjecting the material to be worked to the plural press forming to obtain a plurality of patterns of irregularities arranged.

2. Description of the Related Art

The heat transfer member of the heat exchanger, which is generally formed of a metallic sheet, is press-formed into a prescribed shape, thus providing a finished product, which is to be put into practice. With respect to manufacture of the heat transfer member with the use of the press-forming device, a set of metallic molds have conventionally been used. More specifically, the material to be worked is held between the molds. Motion of moving the molds closely to each other has formed a pattern of irregularities serving as the heat transfer face on the metallic thin sheet of the material to be worked.

The press forming of the heat transfer member has conventionally been carried out in this manner. A set of molds forms the pattern of irregularities of the whole heat transfer member. It is therefore impossible to form any pattern of irregularities having a size larger than the molds. As a result, there is a restriction that the size of the heat transfer member depends on the size of the molds, thus making it impossible to manufacture the heat transfer member having a large area due to limitation of the size of the molds.

The metallic thin sheet used as the material for the heat transfer member, which has been coiled, has no linear property by which the longitudinal opposite side edges are in parallel with each other, due to heterogeneity in stress distribution and distraction during a rolling process, with the result that the metallic thin sheet is slightly curved into the so-called "banana-shape". Formation of the elongated heat transfer member with the use of the banana-shaped metallic thin sheet causes a problem that a plurality of press-forming positions cannot accurately been determined from the longitudinal opposite side edges and an accurate press forming cannot be carried out.

SUMMARY OF THE INVENTION

An object of the present invention, which was made to solve the above-mentioned problems, is therefore to provide a method for manufacturing a heat transfer member, which permits to apply the plural press forming on the material to be worked, utilizing a press-forming device, to form a plurality of prescribed patterns of irregularities as arranged, and permits to manufacture easily the heat transfer member having a large heat transfer face than an area of the mold by forming the proper irregularities on the elongated material.

In order to attain the aforementioned object, a method of the present invention for manufacturing a heat transfer member comprises the steps of:

subjecting material to be worked, which is made of a metallic thin sheet, to a press forming utilizing upper and lower molds of a press-forming devices to form said material into a shape having prescribed irregularities, thereby preparing a heat transfer member for a heat exchanger, wherein:

an elongated material is used as said material to be worked;

a press-forming device is provided with molds each having a length shorter than said elongated material; and said press forming is carried out by press-forming, while feeding said elongated material in a single feeding direction in parallel with a longitudinal direction of said elongated material, said elongated material on prescribed portions thereof, which have been previously set so as to be placed at prescribed intervals in the longitudinal direction of said elongated material, utilizing said press-forming device, thereby preparing the heat transfer member having a plurality of patterns of irregularities, which are arranged in the longitudinal direction of said elongated material.

In the present invention, the plural press forming is carried out, while moving the elongated material to be worked with the use of the prescribed press-forming device, to form a plurality of prescribed patterns of irregularities side by side. It is therefore possible to carry out an appropriate press forming on the entirety of the elongated material to be worked. As a result, the elongated heat transfer member having a larger size than the mold can be manufactured in a reliable manner, thus permitting manufacture of a heat exchanger, which has the large heat transfer member to enhance the heat exchange effectiveness.

In the second aspect of the present invention, as an occasion demands, a plurality of additional press-forming devices each being provided with molds having a length shorter than said elongated material to be worked may be provided so as to be arranged in a feeding direction of said elongated material to be worked on upstream and downstream sides of said press-forming device; and a press-forming may be applied, before and after the press forming on the portions of the elongated material to be worked utilizing said press-forming device, to both prescribed regions on one longitudinally extending side edge portion of the elongated material to be worked and prescribed regions on an other longitudinally extending side edge portion thereof utilizing any one of said additional press-forming devices, thereby preparing the heat transfer member having at least two kinds of patterns of irregularities, which are arranged in the longitudinal direction of said elongated material to be worked.

According to the features of the second aspect of the present invention, the press-forming is applied to the one longitudinally extending side edge portion of the material to be worked with the use of any one of the additional press-forming devices and also to the other longitudinally extending side edge portion of the material to be worked with the use of any one of the additional press-forming devices, so as to form the patterns of irregularities, which are different from the pattern of irregularities of the longitudinally extending central portion of the material to be worked. Such patterns of irregularities are arranged in combination with the other pattern of irregularities. It is therefore possible to carry out an appropriate press forming on the elongated material to be worked to form the optimum patterns of irregularities serving as a heat transfer section. It is also possible to form heat transfer sections in which the heat exchanging capacity is optimized, on the longitudinally extending opposite edge portions having required conditions, which are different from the longitudinally extending central portion. Continuous forming steps can also be carried out with the use of the press-forming devices as arranged, thus improving remarkably the forming operation efficiency.

In the third aspect of the present invention, as an occasion demands, the method may further comprise the step of forming flange portions on longitudinally extending opposite edge portions of the material to be worked so as to make a difference in level from a longitudinally extending central portion thereof, utilizing said press-forming device.

According to the features of the third aspect of the present invention, the flange portions are formed on the longitudinally extending opposite edge portions of the material to be worked, by means of the press-forming device, thus imparting a prescribed bending strength in the longitudinal direction to the material to be worked. Accordingly, even when the material to be worked is elongated, it does not easily bend. It is therefore possible to maintain properly the shape of the material as worked to facilitate the subsequent steps and increase the strength of the heat transfer member.

In the fourth aspect of the present invention, as an occasion demands, the method may further comprise the step of: forming flat portions having a prescribed width on longitudinally extending opposite edge portions of the material to be worked so as to make a difference in level from a longitudinally extending central portion thereof, as well as any set of prescribed recess portions and prescribed projection portions on said flat portions at prescribed intervals in the longitudinal direction of the material to be worked, utilizing said press-forming device.

According to the features of the fourth aspect of the present invention, the flat portions and the recess portions or the projection portions are formed on the longitudinally extending opposite edge portions of the material to be worked, by means of the press-forming device so that the flat portions serve as an area to which a subsequent connecting step is to be applied. When the material to be worked, which has been subjected to the press forming, is finally welded to the other material to be worked to form a heat transfer member, it is possible to utilize the flat portions as the area to which the welding step is to be applied, facilitating a welding operation. In addition, the material to be worked can be held by clamping the flat portions from opposite sides of the material to be worked in its transverse direction, thus providing an easy conveying operation of the material to be worked. Further, forming the recess portions or the projection portions on the flat portions of the material to be worked imparts the bending strength in the transverse direction to the material to be worked. Accordingly, the flat portions do not easily bend in the transverse direction of the material to be worked so as to prevent the material to be worked from bending in the transverse direction when holding it, while clamping the flat portions thereof.

In the fifth aspect of the present invention, as an occasion demands, the method may further comprise the steps of:

detecting, prior to the press forming of said material to be worked utilizing said press-forming device, any one of surface condition and internal structure of said material to be worked utilizing a detection device to obtain detection data;

analyzing said detection data utilizing a data analyzing device to judge existence of defects on any one of a surface and an inside of said material to be worked; and in case where there is made a judgment that the defects exist on said material to be worked, stopping a feeding operation of the material to be worked to the press-forming device, removing respective portions having the defects from a downstream side and a upstream side of said defects of the material to be worked, and then feeding the material to be worked to the press-forming device, while detecting new defects after said defects in the feeding direction of the material to be worked utilizing said detection device.

According to the features of the fifth aspect of the present invention, an image of the material to be worked is previously captured by means of an imaging device, prior to the press forming, so as to check the existence of defects on the surface of the material to be worked, and in case where any defects exist, the material to be worked, from which the portion having the defects has been removed, is fed to the press-forming device in a free state of defects. It is therefore possible to avoid problems that the defects are recognized after press-forming the material to be worked by means of the press-forming device and such a press-formed material is identified as an improperly finished product, resulting in waste of the material to be worked. Feeding the material to be worked, from which the portion having the defects has been removed in a reliable manner, to the press-forming device makes it possible to prevent the defects from being erroneously left on the heat transfer member after the press forming thereof, thus ensuring safety.

In the sixth aspect of the present invention, as an occasion demands, the method may further comprise the steps of:

putting, prior to the press forming of said material to be worked utilizing said press-forming device, a plurality of marks for defining prescribed positions of the material to be worked to which the press forming is to be applied, on a surface of the material to be worked at prescribed intervals in the longitudinal direction of the material to be worked, utilizing a marking device; and conducting the press forming on the prescribed positions of the material to be worked, which are defined by said marks, utilizing said press-forming device, when said marks of the material to be worked, which is fed in the single feeding direction, are detected by means of a mark detection device.

According to the features of the sixth aspect of the present invention, the marks for defining the positions of the material to be worked to which the press forming is to be applied, are previously put by means of the marking device, prior to the press forming. While detecting the marks by means of the mark detection device of the press-forming device, the press forming is applied to the material to be worked, in accordance with the marks as put so that the patterns of irregularities are formed on the portions of the material to be worked, on which the marks are put. It is therefore possible to carry out the press forming on the appropriate positions of the material to be worked, while obtaining information on the positions to which the press forming is to be applied, so as to make a precise positional adjustment for the press forming, thus improving accuracy of the shape of the heat transfer member as manufactured.

DETAILED DESCRIPTION OF THE PREFERRED EMBODIMENTS

[First Embodiment of the Present Invention]

Figure 1:
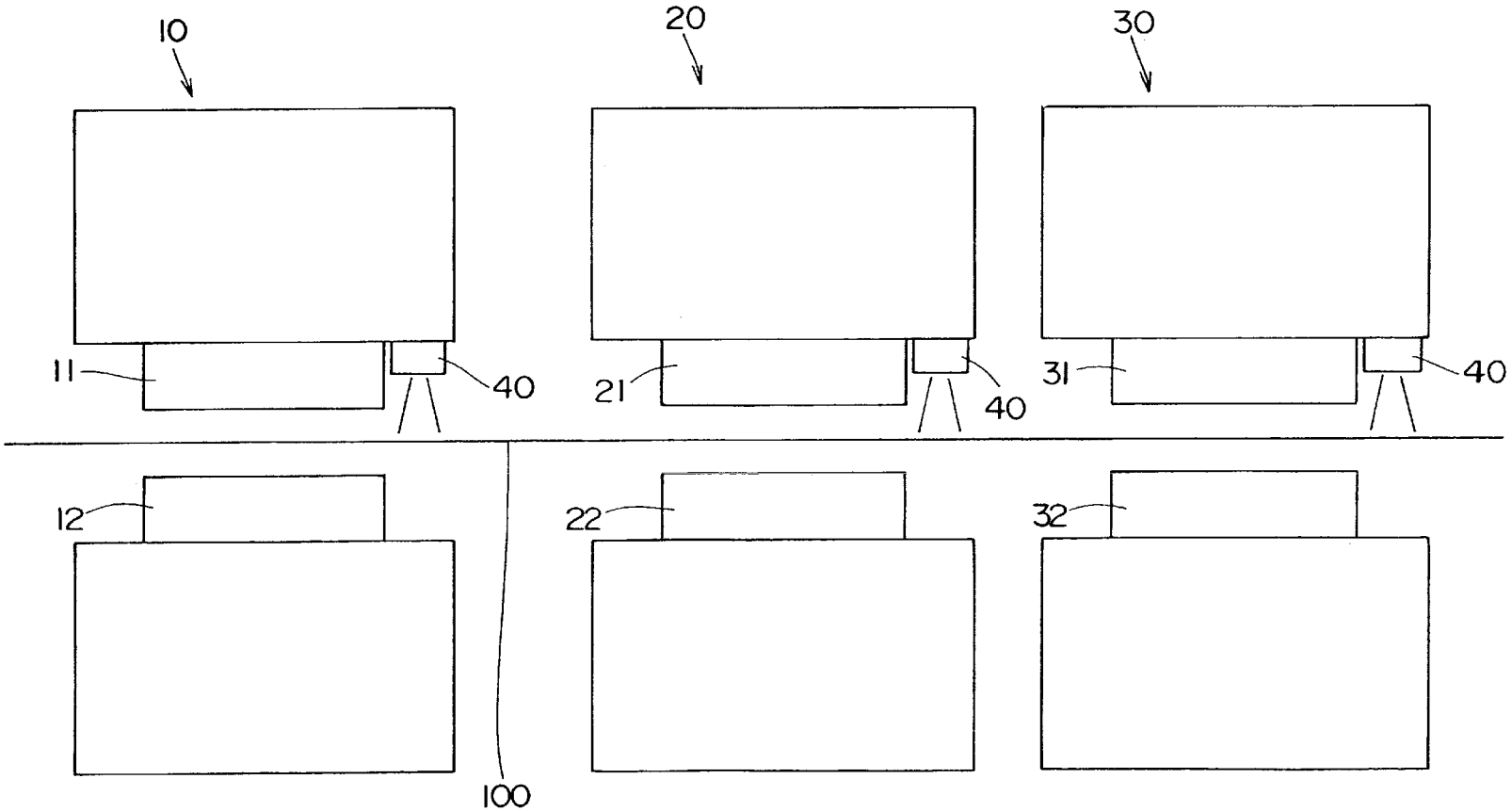
FIG. 1 is a descriptive view illustrating a schematic structure of a press-forming device used in a method for manufacturing a heat transfer member of the first embodiment of the present invention.
Figure 2:
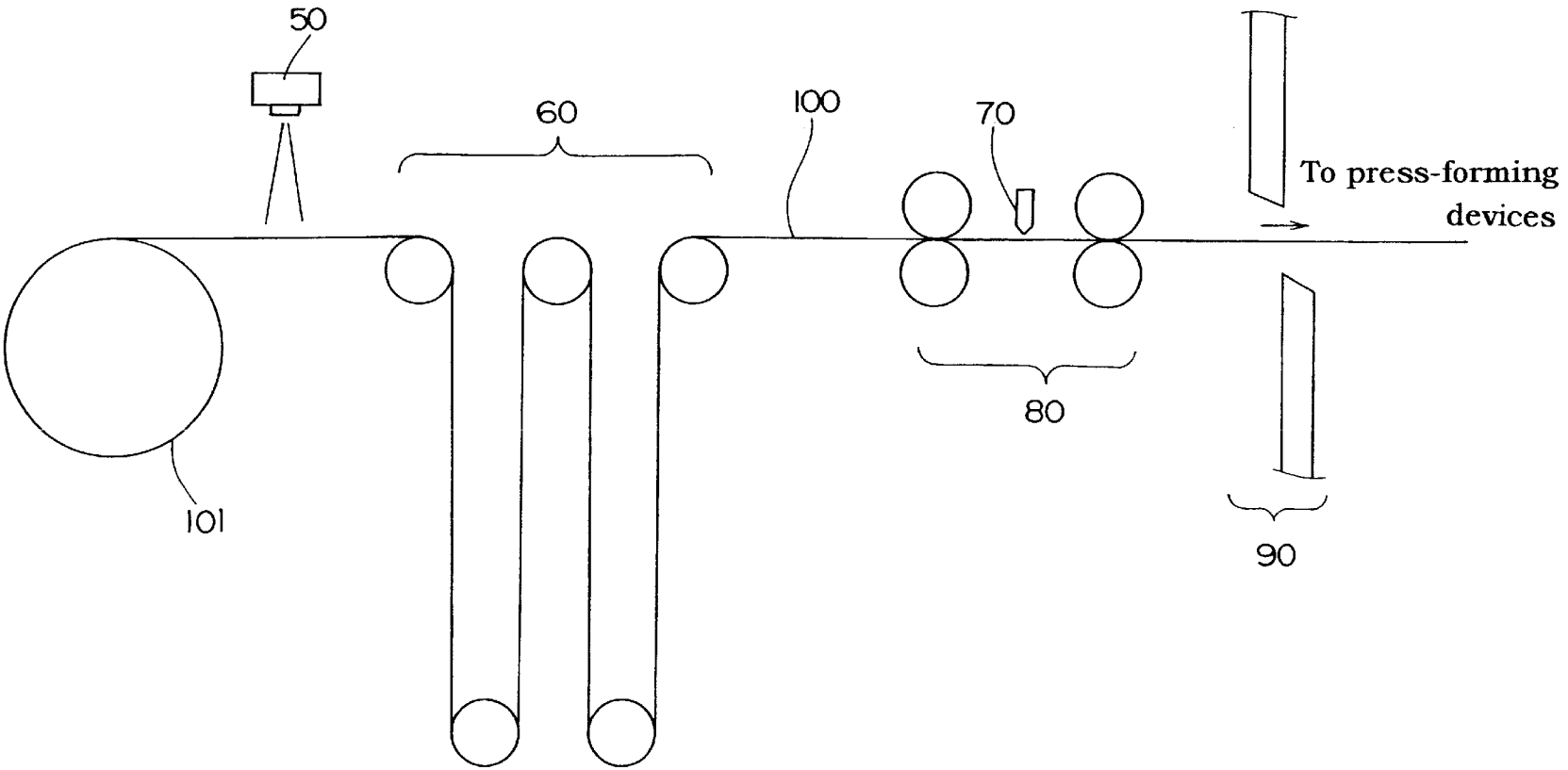
FIG. 2 is a descriptive view illustrating a state in which materials to be worked are supplied in accordance with the method for manufacturing the heat transfer member of the first embodiment of the present invention.
Figure 3:
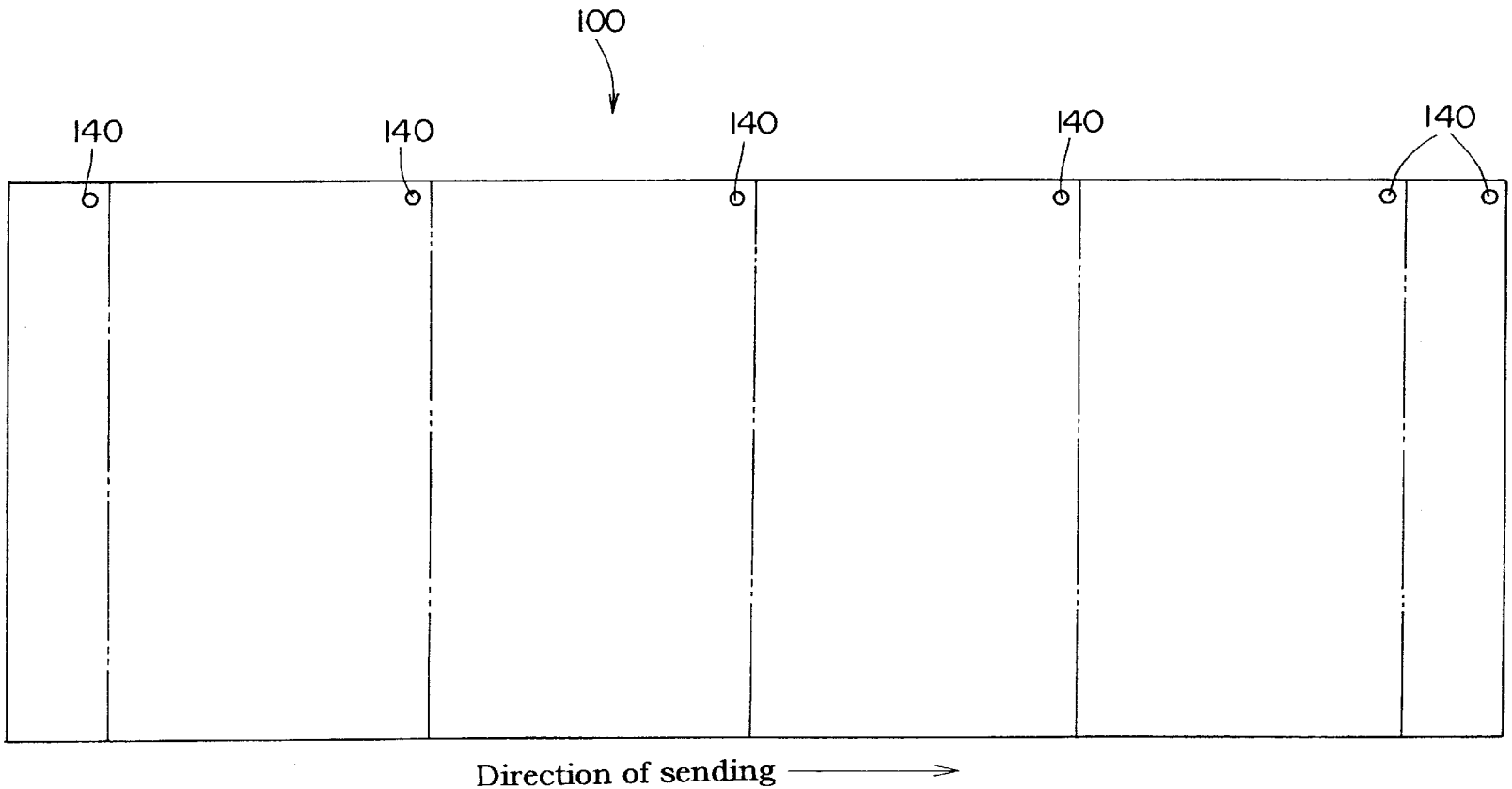
FIG. 3 is a descriptive view illustrating a state in which marks are put on the materials to be worked in accordance with the method for manufacturing the heat transfer member of the first embodiment of the present invention.

Now, a method for manufacturing a heat transfer member of the first embodiment of the present invention will be described in detail below with reference to FIGS. 1 to 5. FIG. 1 is a descriptive view illustrating a schematic structure of a press-forming device used in a method for manufacturing a heat transfer member of the first embodiment of the present invention, FIG. 2 is a descriptive view illustrating a state in which materials to be worked are supplied in accordance with the method for manufacturing the heat transfer member of the first embodiment of the present invention, FIG. 3 is a descriptive view illustrating a state in which marks are put on the materials to be worked in accordance with the method for manufacturing the heat transfer member of the first embodiment of the present invention, FIG. 4 is a descriptive view illustrating a step for press-forming the materials to be worked in accordance with the method for manufacturing the heat transfer member of the first embodiment of the present invention and FIG. 5 is a descriptive view illustrating a state in which the press forming is completely applied to the materials to be worked in accordance with the method for manufacturing the heat transfer member of the first embodiment of the present invention.

In the method for manufacturing a heat transfer member of the first embodiment of the present invention as shown in FIGS. 1 to 5, a press forming is applied to a material to be worked 100, which is formed of an elongated metallic thin sheet, utilizing two press-forming devices 10, 30, i.e., the first and third devices of three press-forming devices, which are disposed so as to be arranged in the feeding direction of the material to be worked 100, to press-form the longitudinally extending opposite edge portions of the material to be worked 100. In addition, a press forming is applied a plurality of times to the material to be worked 100, which is fed sequentially by a prescribed distance, utilizing the intermediate press-forming device 20 to form the prescribed patterns of irregularities at prescribed intervals in the longitudinal direction of the material to be worked in an arranged state, thus preparing a heat transfer member for a heat exchanger.

The press-forming devices 10, 20, 30 used in the method for manufacturing a heat transfer member of the embodiment of the present invention have upper molds 11, 21, 31, lower molds 12, 22, 32 and mark detection devices 40, respectively. Each of the upper molds 11, 21, 31 has a molding face, which faces downward and is movable up and down within a prescribed range to define a formed shape on one surface of the heat transfer member. Each of the lower molds 12, 22, 32 has a molding face, which faces upward. The lower molds 12, 22, 32 are disposed below the upper molds 11, 21, 31 so as to face them, respectively. The mark detection devices 40 are disposed in the vicinity of the upper molds 11, 21, 31, respectively. The mark detection devices 40 judge whether or not the portion of the material to be worked 100 reaches the pressing position between the upper molds 11, 21, 31 and the lower molds 12, 22, 32, respectively.

Figure 5:
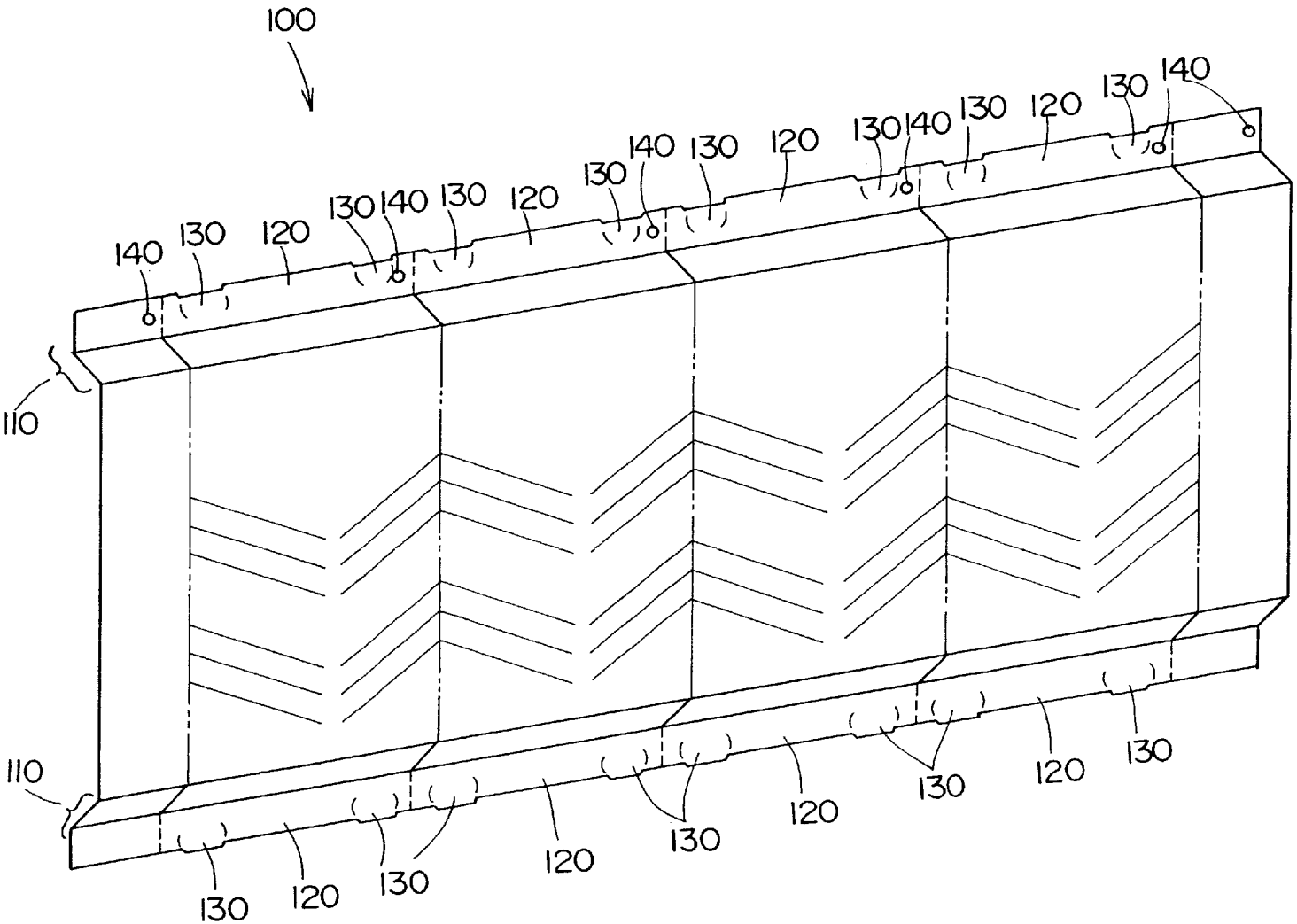
FIG. 5 is a descriptive view illustrating a state in which the press forming is completely applied to the materials to be worked in accordance with the method for manufacturing the heat transfer member of the first embodiment of the present invention.

The upper molds 11, 21, 31 and the lower molds 12, 22, 32 of the press-forming device 10, 20, 30 have the molding faces by which the prescribed patterns of irregularities are formed on the longitudinally extending central portion of the material to be worked 100, flange portions 110 are continuously formed on the longitudinally extending opposite edge portions of the material to be worked 100 so as to make a difference in level from the longitudinally extending central portion thereof, flat portions 120 each having a prescribed width are formed on the respective outer area of the flange portions 110 in the transverse direction of the material to be worked 100, and projection portions 130 each having a prescribed height are formed on the flat portions 120 at the prescribed intervals in the longitudinal direction of the material to be worked (see FIG. 5). The flange portions 110, the flat portions and the projection portions 130 are formed on the longitudinally extending opposite edge portions of the material to be worked 100 in this manner so that the flange portions 110 impart a sufficient bending strength in the longitudinal direction of the material to be worked 100 and the projection portions 130 impart a sufficient bending strength in the transverse direction of the material to be worked 100. As a result, the material to be worked 100 does not easily deform so as to permit to maintain a proper shape of the material to be worked 100 after completion of the press forming, thus making it possible to carry out easily the subsequent steps. In addition, the flat portions 120 serve as an area to which a subsequent connecting step is to be applied after the completion of the press-forming step of the material to be worked 100. In case where the materials to be worked 100 are finally welded together to form the heat transfer member after the press-forming step, it is possible to utilize the flat portions 120 as the area to which the welding step is to be applied, facilitating a welding operation. Further, the material to be worked 100 can be held by clamping the flat portions 120 from opposite sides of the material to be worked 100 in its transverse direction, thus providing an easy conveying operation of the material to be worked 100.

An imaging device 50 for imaging surface conditions of the material to be worked 100 is provided before the press-forming devices 10, 20, 30 and immediately after a position from which a coil 101 for the material to be worked 100 is uncoiled, in the feeding direction of the material to be worked 100. An image-analyzing device (not shown) analyzes the image obtained by means of the imaging device 50 to judge existence of defects on the surface of the material to be worked 100. In case where there is made a judgment that the defects exist on the material to be worked 100, a feeding operation of the material to be worked 100 to the press-forming device is stopped, respective portions having the defects from the downstream side and the upstream side of the defects of the material to be worked 100 are removed, and then the material to be worked 100 is fed to the press-forming device, while imaging new defects after the defects in the feeding direction of the material to be worked 100 utilizing the imaging device 50.

A zone (i.e. a pool zone 60) for storing the material to be worked 100 by a prescribed length, with which at least the single heat transfer member can be formed, is provided between the position on which the imaging step is carried out by means of the imaging device, and the press-forming device 10. The pool zone 60 surely stores the material to be worked 100 having a sufficient length. As a result, even if the defects of the material to be worked 100 are detected and portions thereof having such defects are removed, the material to be worked 100, which is placed on the downstream side of the defects as detected in the feeding direction of the material to be worked 100, can be completely subjected to the press forming to ensure formation of the single heat transfer member, thus reducing loss of the material to be worked 100.

In addition, a smoothening device 80, which is composed of two pairs of rollers, is disposed between the pool zone 60 and the press-forming device 10. A marking device 70 for putting a plurality of marks 140 on the surface of the material to be worked 100 at prescribed intervals in the longitudinal direction thereof is disposed between the two pairs of rollers of the smoothening device 80. The marks 140 define prescribed positions of the material to be worked 100 to which the press forming is to be applied. The respective press-forming devices conduct the press forming to the prescribed positions of the material to be worked 100, which are defined by the marks 140, when the marks 140 of the material to be worked 100 traveling in the prescribed single direction are detected by means of the respective mark detection devices 40.

Now, description will be given of the press-forming operation of the material to be worked in accordance with the method for manufacturing the heat transfer member of the embodiment of the present invention. The material to be worked 100 is continuously monitored to detect any defects immediately after the place from which the material to be worked 100 is uncoiled from the coil 101 (see FIG. 2). In case where no defects are detected, the material to be worked 100 passes through the pool zone 60 and then is subjected to a smoothening treatment by means of the smoothening device 80. Then, the marks 140, which define the positions of the material to be worked 100 to which the press forming is to be applied, are put on the surface of the material to be worked 100 at the prescribed intervals in the longitudinal direction by means of the marking device 70. The material to be worked 100 is then supplied to the press-forming device. The marks 140 are put at the prescribed intervals not only on the prescribed positions of the longitudinally extending opposite edge portions of the material to be worked 100, which coincide with the feeding direction of the material to be worked 100, but also on the longitudinally extending central portion of the material to be worked 100, which is located between the longitudinally extending opposite edge portions thereof (FIG. 3).

After completion of the marking step, the press forming is carried out first by means of the most rearward side press-forming device 10 of the three press-forming devices in the feeding direction of the material to be worked. The press-forming device 10 is previously kept in an initial state in which the upper mold 11 and the lower mold 12 are separated from each other. A material feeding device (not shown) supplies the material to be worked 100 so that the front end of the material to be worked is inserted between the upper mold 11 and the lower mold 12 of the press-forming device 10. The mark detection operation is carried out by means of the mark detection device 40 of the press-forming device 10, when the material to be worked 100 is fed between the upper and lower molds of the press-forming device 10.

Figure 4A:
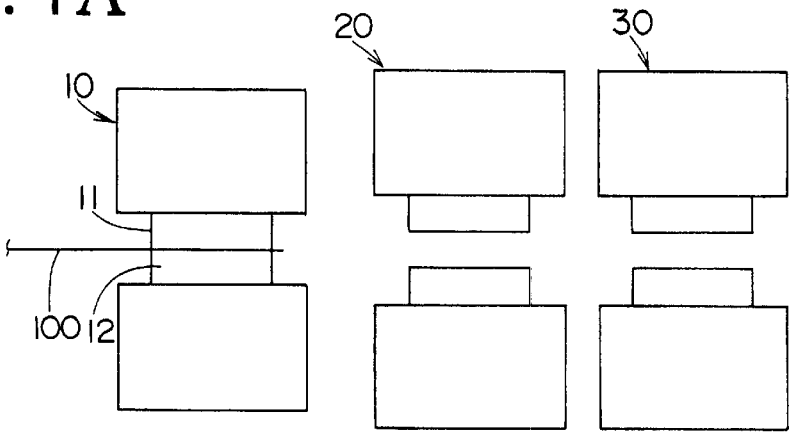
FIG. 4, consisting of FIGS. 4A, 4B, and 4C, is a descriptive view illustrating a step for press-forming the materials to be worked in accordance with the method for manufacturing the heat transfer member of the first embodiment of the present invention.
Figure 4B:
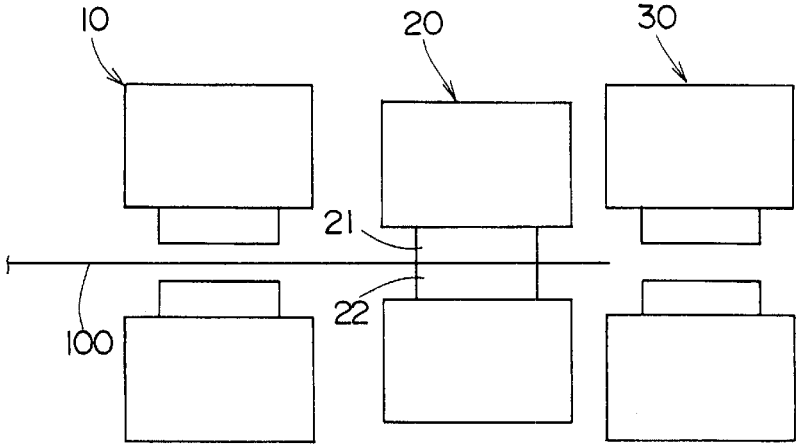
Figure 4C:
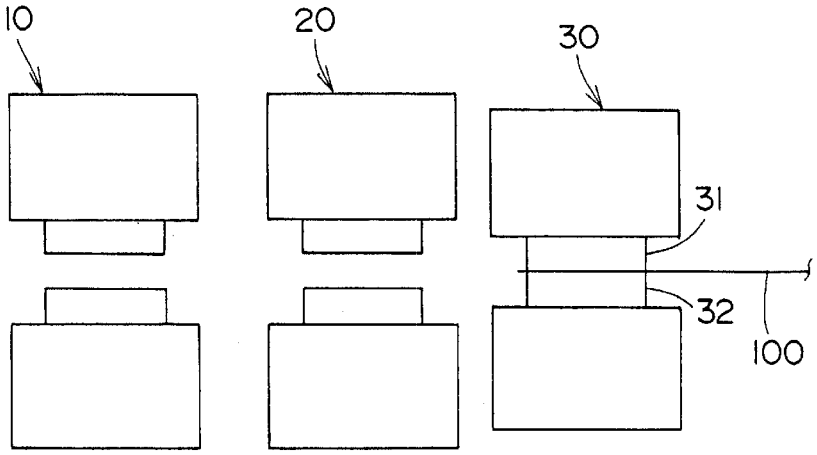

When the front end of the material to be worked 100 reaches the position between the molds of the press-forming device 10 and the mark detection device 40 detects the mark 140, which is closest to the front end of the material to be worked, the feeding operation of the material to be worked 100 is stopped temporarily so that the upper mold 11 and the lower mold 12 of the press-forming device 10 approach each other to press-form the material to be worked 100 (see FIG. 4(A)). The front end portion of the material to be worked 100 is pressed by means of the upper mold 11 and the lower mold 12 of the press-forming device 10 to apply pressure equally to the material to be worked 100 thereby forming the prescribed pattern of irregularities according to the molds in a reliable manner.

After the completion of applying the press forming to the front-end portion of the material to be worked, the upper mold 11 and the lower mold 12 of the press-forming device 10 are separated from each other. Then, the feeding operation of the material to be worked 100 utilizing the material feeding device is started again to move the front end of the material to be worked 100 to the next press-forming device 20 from the first press-forming device 10.

Then, the press forming is carried out by means of the intermediate press-forming device 20 in the feeding direction of the material to be worked. The press-forming device 20 is previously kept in an initial state in which the upper mold 21 and the lower mold 22 are separated from each other. The material feeding device supplies the material to be worked 100 so that the front end portion of the material to be worked, on which the pattern of irregularities has already been formed, passes through between the upper and lower molds of the press-forming device 20 and the adjacent portion of the material to be worked 100 to the front end thereof moves to a position between the upper mold 21 and the lower mold 22.

Also in the press-forming device 20, the mark detection operation is carried out by means of the mark detection device 40. When the adjacent portion of the material to be worked 100 to the front end thereof reaches the position between the molds of the press-forming device 20 and the mark detection device 40 detects the mark 140, which is secondly placed from the front end of the material to be worked, the feeding operation of the material to be worked 100 is stopped temporarily so that the upper mold 21 and the lower mold 22 of the press-forming device 20 approach each other to press-form the material to be worked 100 (see FIG. 4(B)). The adjacent portion of the material to be worked 100 to the front end thereof is pressed by means of the upper mold 21 and the lower mold 22 of the press-forming device 20 to apply pressure equally to the material to be worked 100 thereby forming the prescribed pattern of irregularities according to the molds in a reliable manner.

After the completion of applying the press forming to the adjacent portion of the material to be worked 100 to the front end thereof, the upper mold 21 and the lower mold 22 of the press-forming device 20 are separated from each other. Then, the feeding operation of the material to be worked 100 utilizing the material feeding device is started again to move the material to be worked 100 in the feeding direction thereof until the next mark 140 is detected by means of the mark detection device 40. After detection of the next mark 140 utilizing the mark detection device 40, the other prescribed portion of the material to be worked 100 is newly press-formed by means of the press-forming device 20 in the same manner.

A series of the feeding step of the material to be worked 100, the mark detection step and the press-forming step is repeated by the number of the marks 140 other than the marks 140, which are located on the rearmost sides of the material to be worked 100. The press-forming device 20 conducts a plurality of times the press forming to the material to be worked 100, which is intermittently fed by the prescribed feeding length, on the basis of instructions for the press forming given in accordance with the marks 140, to form the patterns of irregularities so as to align at the prescribed intervals in the longitudinal direction of the material to be worked.

After completion of all the plurality of press-forming steps utilizing the press-forming device 20, the press-forming device 30, which is placed in the most forward side in the feeding direction of the material to be worked, is caused to carry out the press forming operation. The press-forming device 30 is previously kept in an initial state in which the upper mold 31 and the lower mold 32 are separated from each other. The material feeding device supplies the material to be worked 100 so that the portions of the material to be worked, on which the patterns of irregularities have already been formed, pass through between the upper and lower molds of the press-forming device 30 and the rear end portion of the material to be worked 100 moves to a position between the upper mold 31 and the lower mold 32. More specifically, the other end of the material to be worked 100 in its longitudinal direction is inserted between the upper mold 31 and the lower mold 32.

Also in the press-forming device 30, the mark detection operation is carried out by means of the mark detection device 40. When the rear end portion of the material to be worked 100 reaches the position between the molds of the press-forming device 30 and the mark detection device 40 detects the mark 140, which is placed on the rearmost side of the material to be worked, the feeding operation of the material to be worked 100 is stopped temporarily so that the upper mold 31 and the lower mold 32 of the press-forming device 30 approach each other to press-form the material to be worked 100 (see FIG. 4(C)). The rear end portion of the material to be worked 100 is pressed by means of the upper mold 31 and the lower mold 32 of the press-forming device 30 to apply pressure equally to the material to be worked 100 thereby forming the prescribed pattern of irregularities according to the molds in a reliable manner. A cutting step is applied to the material to be worked 100 by means of a cutting unit 90 during the press-forming step utilizing the press-forming device 30.

After completion of the press-forming step utilizing the press-forming device 30, the upper mold 31 and the lower mold 32 of the press-forming device 30 are separated from each other. Then, the feeding operation of the material to be worked 100 utilizing the material feeding device is started again to move the material to be worked 100 in the feeding direction, thereby discharging it from the press-forming device 30. The material as worked is conveyed as the heat transfer member to a zone for carrying out the subsequent step.

In the method for manufacturing the heat transfer member of the embodiment of the present invention, the press-forming step is applied to the elongated material to be worked 100 a plurality of times, utilizing the press-forming device 20, while intermittently moving the material to be worked 100 to shift the press-forming position, so as to form the plurality of prescribed patterns of irregularities so as to align on the material to be worked 100. It is therefore possible to apply the press forming to the entirety of the elongated material to be worked 100 to form the patterns of irregularities. As a result, it is possible to manufacture the elongated heat transfer member having a larger size than the molds in a reliable manner. There can be manufactured the heat exchanger in which the size of the heat transfer member can be increased to enhance the heat exchange effectiveness.

The image of the material to be worked is previously captured by means of the imaging device 50, prior to the press forming, so as to check the existence of defects on the surface of the material to be worked 100, and in case where any defects exist, the material to be worked 100, from which the portion having the defects has been removed, is fed to the press-forming devices 10, 20, 30 in a free state of defects. It is therefore possible to feed the material to be worked 100 having no defects to the press-forming devices to carry out the press-forming steps. There is therefore avoided a problem that the defects are left on the heat transfer member as press-formed, thus preventing formation of an improperly finished product and ensuring safety.

In addition, the marks for defining the positions of the material to be worked 100 to which the press forming is to be applied, are previously put by means of the marking device 70. When the mark detection device 40 of each of the press-forming devices 10, 20, 30 detects the marks 140, the press forming is applied to the material to be worked 100 in accordance with the mark 140. It is therefore possible to carry out the press forming on the appropriate positions of the material to be worked 100, while obtaining information on the positions to which the press forming is to be applied, so as to make a precise positional adjustment for the press forming, thus improving accuracy of the shape of the heat transfer member as manufactured.

[Second Embodiment of the Present Invention]

Figure 6:
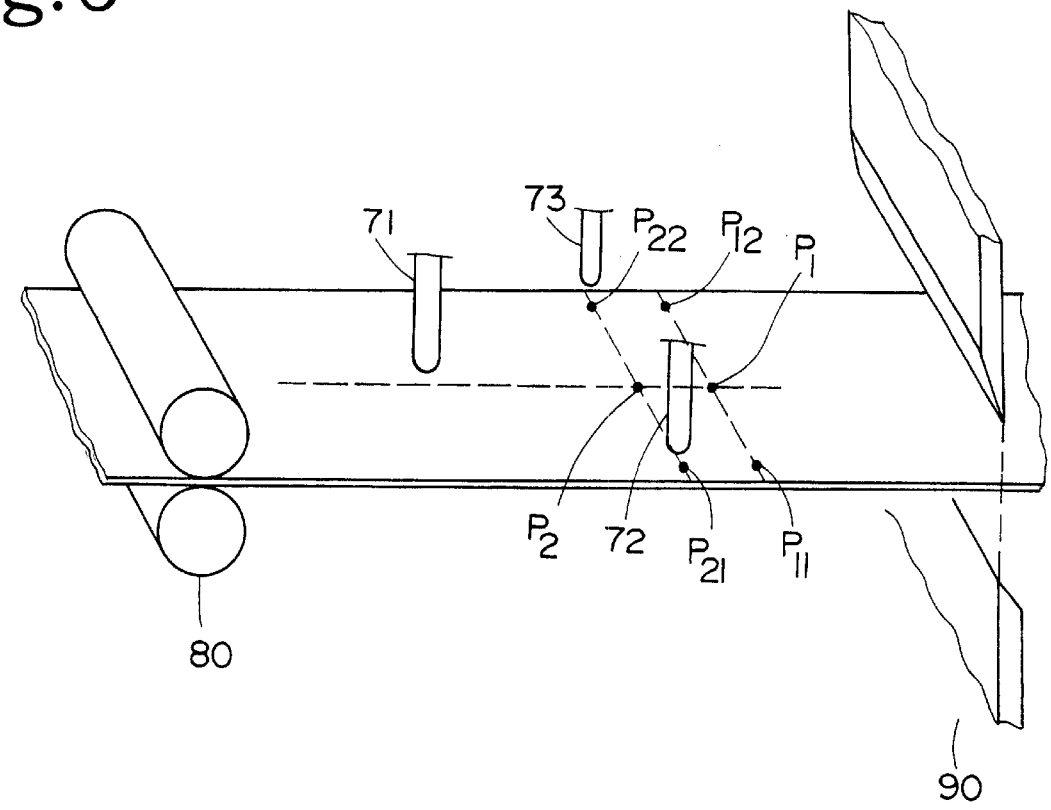
FIG. 6 is a descriptive view illustrating a structure of a marking device, which is provided on the upstream side of the press-forming device in the feeding direction of the material to be worked, in accordance with the method for manufacturing the heat transfer member of the second embodiment of the present invention.
Figure 7A:
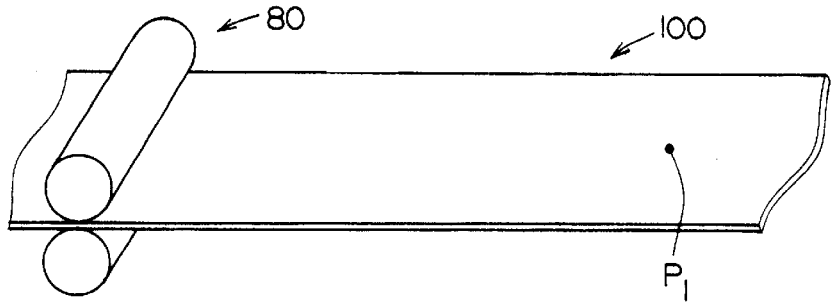
FIG. 7, consisting of FIGS. 7A, 7B, 7C, and 7D, is a descriptive view illustrating an operation for putting marks by means of the marking device as shown in FIG. 6.
Figure 7B:
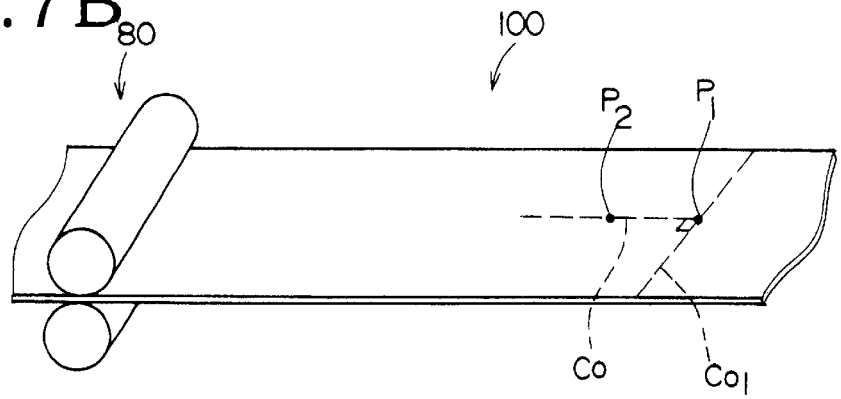
Figure 7C:
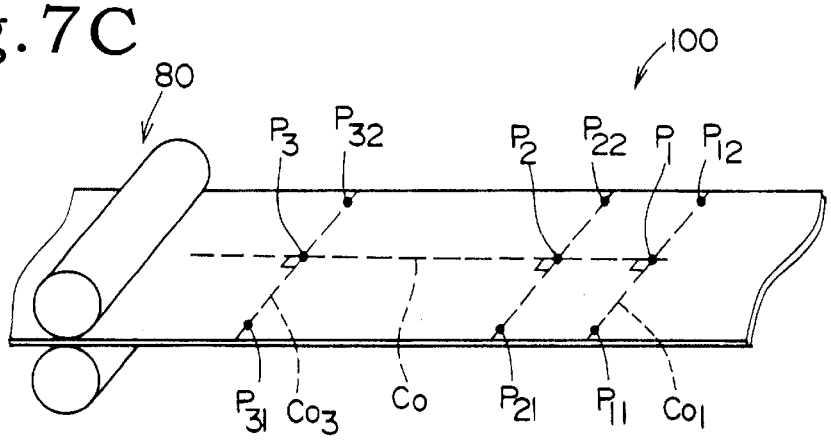
Figure 7D:
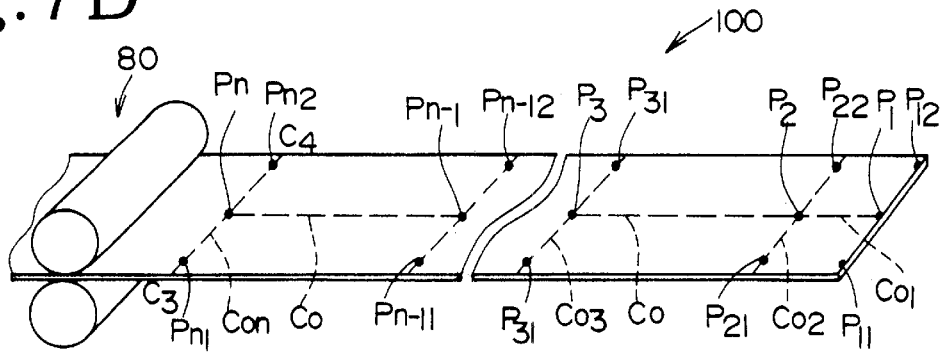

Now, the method for manufacturing a heat transfer member of the second embodiment of the present invention will be described in detail below with reference to FIGS. 6 and 7. FIG. 6 is a descriptive view illustrating a structure of a marking device, which is provided on the upstream side of the press-forming device in the feeding direction of the material to be worked, in accordance with the method for manufacturing the heat transfer member of the second embodiment of the present invention and FIG. 7 is a descriptive view illustrating an operation for putting marks by means of the marking device as shown in FIG. 6.

In the method for manufacturing a heat transfer member of the second embodiment of the present invention as shown in FIGS. 6 and 7, in addition to the structure in which the material to be worked 100 that is formed of an elongated metallic sheet is supplied through the pool zone 60 and the smoothening device 80 to the press-forming devices 10, 20, 30 from the coil 101 in the same manner as the first embodiment of the present invention, a plurality of marks are put on the material to be worked 100 by means of a plurality of application nozzles of the marking device, after the above-mentioned smoothening device 80.

The above-mentioned marking device 71 performs an arithmetic operation of an imaginary central line C0, which is located substantially in the center of the material to be worked 100 so as to put the marks P1, . . . Pn, which correspond the prescribed positions, to which the press forming is to be applied by means of the press-forming devices 10, 20, 30. The application nozzles 72, 73 perform an arithmetic operation of an intersecting line C01, . . . C0*n*, which intersect at right angles the central line C0 as operated, so as to put the marks P11·P12, . . . Pn1·Pn2 on the prescribed opposite positions on the intersecting line C01, . . . C0*n*.

Now, description will be given of the press-forming operation of the material to be worked in accordance with the method for manufacturing the heat transfer member of the embodiment of the present invention. First, the material to be worked 100 is uncoiled from the coil 101 and passes through the pool zone 60 and the smoothening device 80 in the same manner as the first embodiment of the present invention. The marks P1, P2 are put on the central portion of the material to be worked, which is pulled out, by means of the application nozzle 71. The central line C0 is obtained through the arithmetic operation on the imaginary line connecting the marks P1 and P2 to each other. The distance between the marks P1 and P2 corresponds to a zone to which the press forming is applied first.

The intersecting line C01, which intersects the central line C0 thus obtained and passes through the mark P1, is obtained through the arithmetic operation. The marks P11, P12 are put on the positions in the vicinity of the opposite sides of the intersecting line C01 by means of the application nozzles 72, 73. The intersecting line C01 located on the front-end side serves as a portion C1C2, which is to be cut by means of the cutting unit 90. The intersecting line C02, which intersects the central line C0 and passes through the mark P2, is obtained through the arithmetic operation. The marks P21, P22 are put on the positions in the vicinity of the opposite sides of the intersecting line C02 by means of the application nozzles 72, 73.

The above-mentioned central line C0 is extended toward the front side (i.e., the side of the coil 101). The mark P3 is put on a position corresponding to a zone to which the press forming is to be applied second, on the thus extended central line C0 by means of the application nozzle 71. The intersecting line C03, which intersects the extended central line C0 and passes through the mark P3, is obtained through the arithmetic operation. The marks P31, P32 are put on the positions in the vicinity of the opposite sides of the intersecting line C03 by means of the application nozzles 72, 73.

The central line C0 is extended step by step and the marks are put until the number of marks becomes the last (n−1). The intersecting line C0*n* passing through the last mark Pn serves as a portion CnCn+1, which is to be cut by means of the cutting unit 90.

It is therefore possible to form, as the central line C0, a line in which a continuous series of the necessary length to prepare the heat transfer member (i.e., the distance between the mark P1 and the mark Pn) exists, only on a plane including the adjacent three marks P1·P2·P3 (or P2·P3·P4, . . . or Pn−2·Pn−1·Pn). Consequently, the marks P1, . . . Pn, P11, . . . Pn1, P12, . . . Pn2, which define the positions of the material to be worked to which the press forming is to be applied, can be put on the basis of the central line C0 in a reliable and accurate manner even when the material to be worked 100 has a banana-shape.

The material to be worked 100, on which the marks P1, . . . Pn, P11, . . . . Pn1, P12, . . . Pn2 have been put and which has been cut along the intersecting line C01 and the intersecting line C0*n*, is subjected to the press forming utilizing the press-forming devices 10, 20, 30 in the same manner as the first embodiment of the present invention.

[Third Embodiment of the Present Invention]

Figure 8:
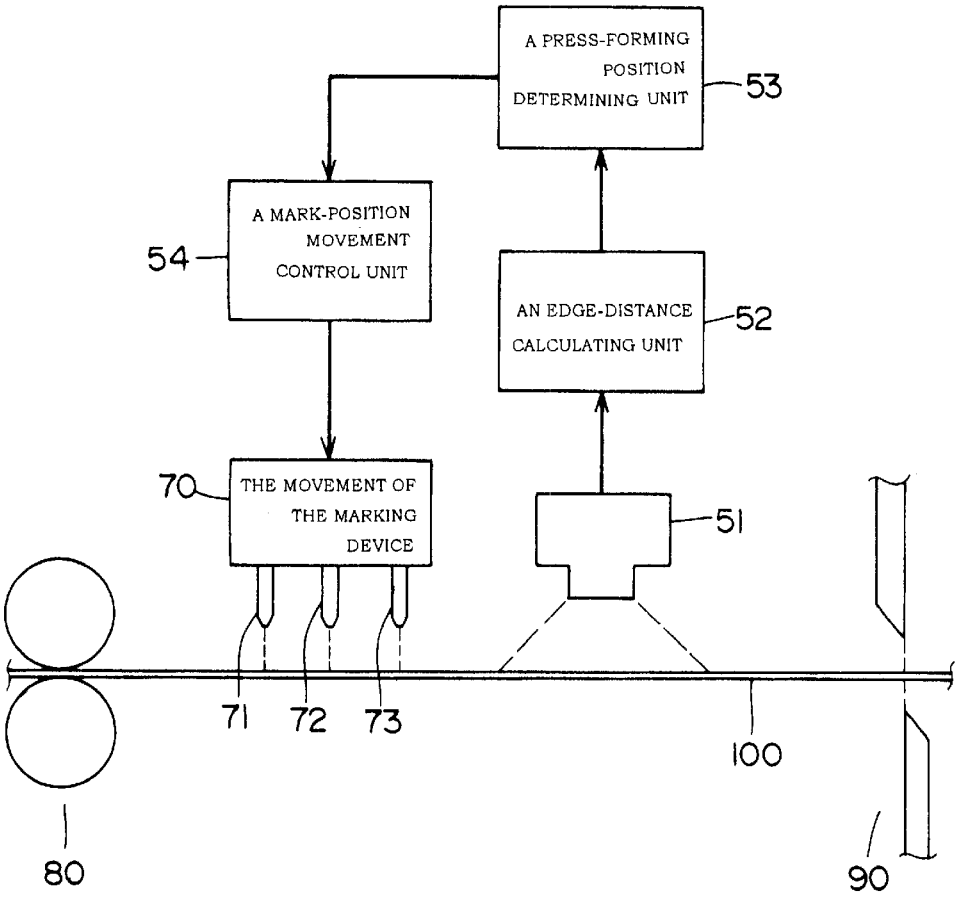
FIG. 8 is a block diagram of a unit for executing the marking operation in accordance with the method for manufacturing the heat transfer member of the third embodiment of the present invention.
Figure 9:
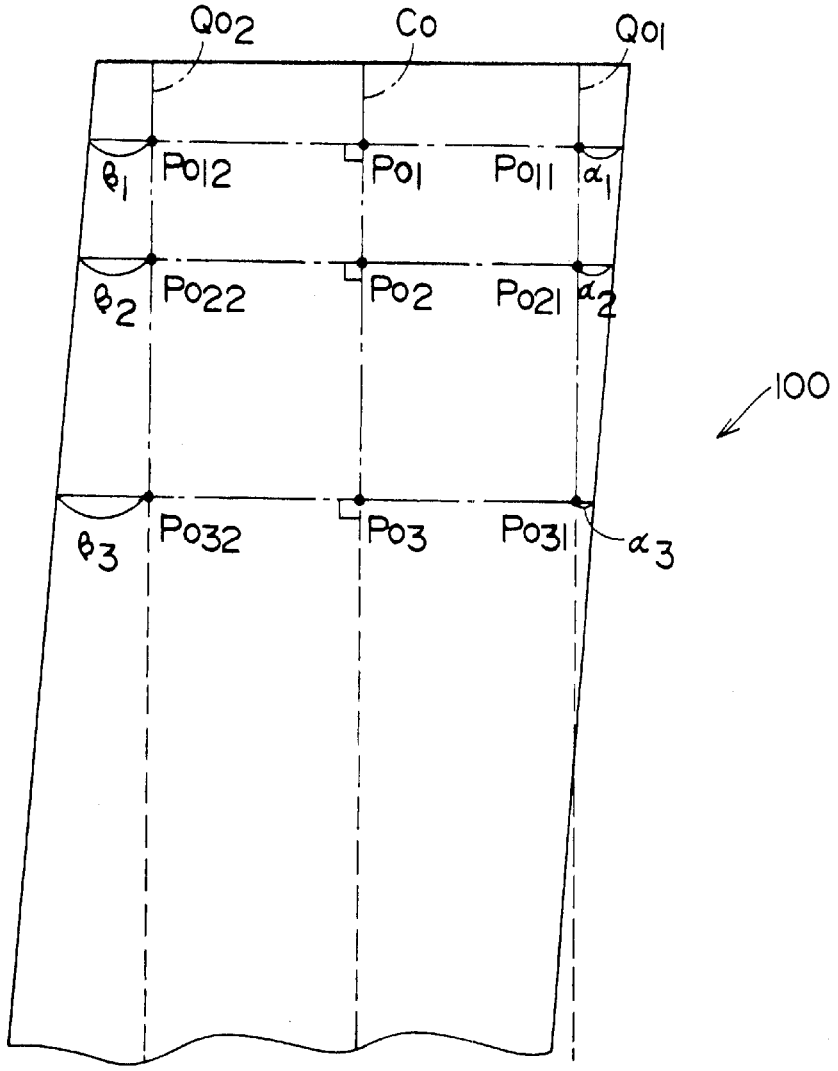
FIG. 9 is a descriptive view illustrating an operation for putting marks in accordance with the method for manufacturing the heat transfer member of the third embodiment of the present invention, as shown in FIG. 8.
Figure 10:
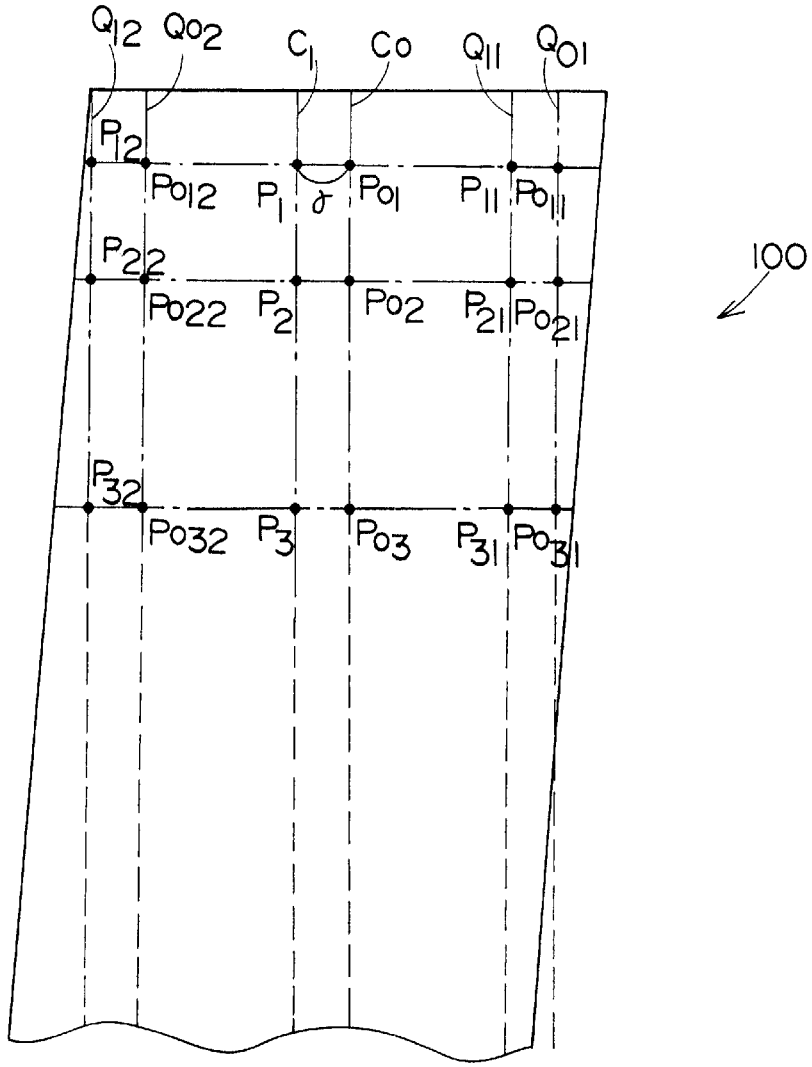
FIG. 10 is a descriptive view illustrating an operation for putting marks in accordance with the method for manufacturing the heat transfer member of the third embodiment of the present invention, as shown in FIG. 8.
Figure 11:
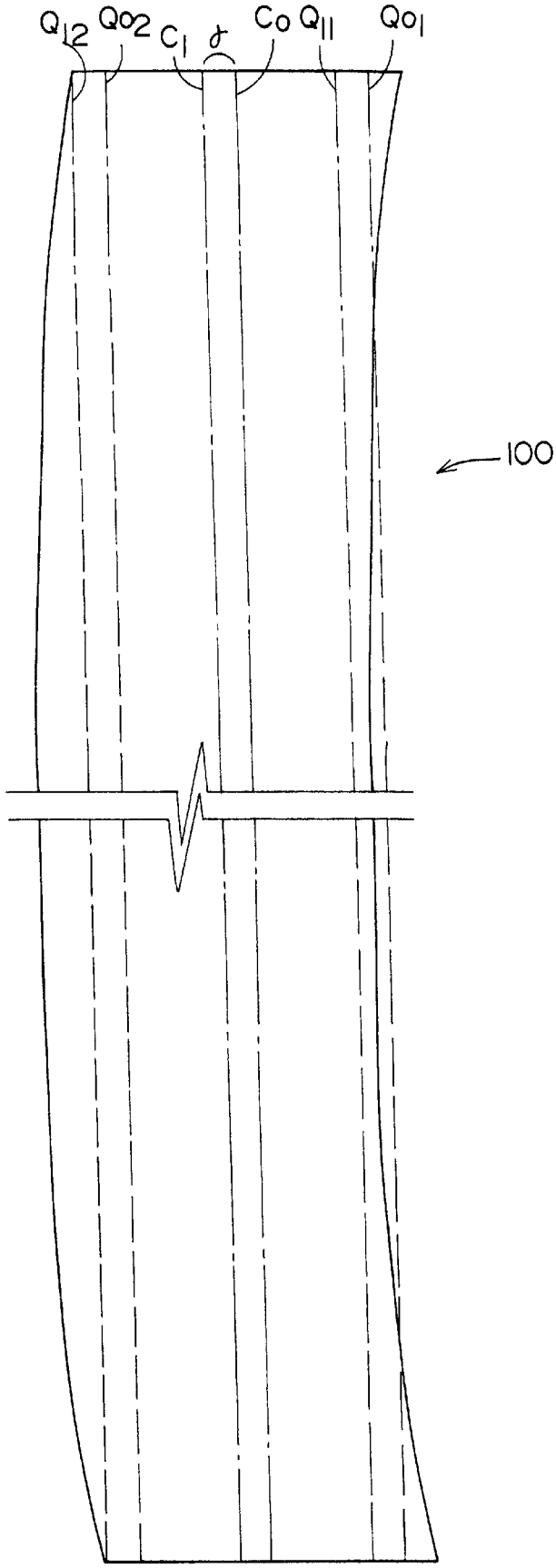
FIG. 11 is a plan view of the entirety of the material to be worked, on which the marks are put in accordance with the method for manufacturing the heat transfer member of the third embodiment of the present invention, as shown in FIG. 8.

Now, the method for manufacturing a heat transfer member of the third embodiment of the present invention will be described in detail below with reference to FIGS. 8 to 11. FIG. 8 is a block diagram of a unit for executing the marking operation in accordance with the method for manufacturing the heat transfer member of the third embodiment of the present invention, FIGS. 9 and 10 are descriptive views illustrating an operation for putting marks in accordance with the method for manufacturing the heat transfer member of the third embodiment of the present invention, as shown in FIG. 8, and FIG. 11 is a plan view of the entirety of the material to be worked, on which the marks are put in accordance with the method for manufacturing the heat transfer member of the third embodiment of the present invention, as shown in FIG. 8.

In the method for manufacturing a heat transfer member of the third embodiment of the present invention as shown in FIGS. 8 to 11, in addition to the structure in which the material to be worked 100 that is formed of an elongated metallic sheet is supplied through the pool zone 60, the smoothening device 80, the marking device 70 and the cutting unit 90 to the press-forming devices 10, 20, 30 from the coil 101 in the same manner as the second embodiment of the present invention, there are provided an edge-imaging device 51, an edge distance calculating unit 52, a press-forming position determining unit 53 and a mark-position movement control unit 54. The edge-imaging device 51 captures an image of the material to be worked 100 over its transverse direction thereof in a place after the smoothening device 80, to obtain an image information on a length of the prescribed portion in the longitudinal direction of the material to be worked 100. The edge distance-calculating unit 52 calculates the edge distance of the material to be worked, the image of which has been captured. The press-forming position determining unit 53 judges the press-forming positions to which the press-forming is applied by means of the press-forming devices 10, 20, 30, respectively, on the basis of the edge distance thus calculated. The mark-position movement control unit 54 controls the movement of the marking device 70 on the basis of the obtained data of the press-forming position, to control the marking position.

The edge distance calculating unit 52 sets imaginary central points P01, P02, P03 and imaginary side edge points P011·P012, P021·P022, P031·P032, which are located on the opposite sides of the above-mentioned imaginary central points P01, P02, P03, respectively, on the surface of the material to be worked 100 on the basis of the image data captured by means of the edge imaging device 51, so as to calculate the edge distances $\alpha 1 \cdot \beta 1$, $\alpha 2 \cdot \beta 2$, $\alpha 3 \cdot \beta 3$, which extend from the imaginary side edge points P011·P012, P021·P022, P031·P032 to the side edge of the material to be worked 100.

The press-forming position determining unit 53 infers the degree of curve of the material to be worked 100 (i.e., the degree of banana-shaped condition) from analogy of the edge distances $\alpha1\cdot\beta1$, $\alpha2\cdot\beta2$, $\alpha3\cdot\beta3$ thus calculated, to judge the press-forming positions of the material to be worked 100, having the degree of curve thus inferred, to which the press-forming is to be applied by means of the press-forming devices 10, 20, 30, so as to output the data of the press-forming positions. The mark-position movement control unit 54 control the marking positions of the material to be worked 100, on which the marks are to be put by means of the marking device 70, on the basis of the data of the press-forming positions thus output.

Now, description will be given of the press-forming operation of the material to be worked in accordance with the method for manufacturing the heat transfer member of the embodiment of the present invention. First, the material to be worked 100 is uncoiled from the coil 101 and passes through the pool zone 60 and the smoothening device 80 in the same manner as the first and second embodiments of the present invention. The edge-imaging device 51 captures the image of the surface of the material to be worked 100, which has been uncoiled. The edge distance calculating unit 52 sets the imaginary central point P01 on the central portion of the material to be worked 100, as shown in FIG. 9, and performs an arithmetic operation of the imaginary central line C01, which extends from the imaginary central point P01 in the longitudinal direction of the material to be worked, on the basis of the image data as captured. The imaginary central points P02, P03 are also set on the imaginary central line C01, at intervals corresponding to the distance by which the press-forming is to be carried out. There are also set the side edge points P011·P012, P021·P022, P031·P032, which are located on the opposite sides of the imaginary central points P01, P02, P03 thus set, respectively, so as to be apart therefrom by the prescribed distance. The edge distance calculating unit 52 calculates the edge distances $\alpha1\cdot\beta1$, $\alpha2\cdot2$, $\alpha3\cdot\beta3$ which extend from the side edge points P011·P012, P021·P022, P031·P032 thus set to the side edge of the material to be worked 100, to output signals to the press-forming position determining unit 53.

The press-forming position determining unit 53 infers the degree of curve of the material to be worked 100 from analogy of transition of the edge distances $\alpha1\cdot\beta1$, $\alpha2\cdot\beta2$, $\alpha3\cdot\beta3$ ($\alpha1>\alpha2>\alpha3$, $\beta1<\beta2<\beta3$) and judges the press-forming positions of the material to be worked 100, having the degree of curve thus inferred, to which the press-forming is to be applied by means of the press-forming devices 10, 20, 30, so as to output the data of the press-forming positions to the mark-position movement control unit 54. The mark-position movement control unit 54 slides the marking device 70 by a correction distance $\gamma$ on the basis of the data of the press-forming positions.

The marking device 70, which has slid, sets a new central line C1 in a position, which is shifted from the imaginary central line C01 by the above-mentioned correction distance $\gamma$. Central points P1, P2, P3 and side edge points P11·P12, P21·P22, P31·P32 . . . are put on the material to be worked 100 in the feeding direction on the basis of the above-mentioned new central line C1 by means of the marking device 70.

It is possible to select the optimum pressing positions of the material to be worked 100 on the basis of the plurality of edge distances $\alpha1\cdot\beta1$, $\beta2\cdot\beta2$, $\alpha3\cdot\beta3$ on the front edge portion of the material to be worked 100, as shown in FIG. 11, even when the material to be worked 100 has a curved shape.

After determination of the press-forming positions, the cutting step and the press-forming step are carried out on the basis of the side edge points P11·P12, P21·P22, P31·P32 . . . , which indicate the press-forming positions, by means of the cutting unit 90 and the press-forming devices 10, 20, 30 in the same manner as the above-described embodiments of the present invention.

According to the present invention as described above, the plural press forming is carried out, while moving the elongated material to be worked with the use of the prescribed press-forming device, to form a plurality of prescribed patterns of irregularities side by side. It is therefore possible to carry out an appropriate press forming on the entirety of the elongated material to be worked. As a result, the elongated heat transfer member having a larger size than the mold can be manufactured in a reliable manner, thus permitting manufacture of a heat exchanger, which has the large heat transfer member to enhance the heat exchange effectiveness.

According to the features of the second aspect of the present invention, the press-forming is applied to the one longitudinally extending side edge portion of the material to be worked with the use of any one of the additional press-forming devices and also to the other longitudinally extending side edge portion of the material to be worked with the use of any one of the additional press-forming devices, so as to form the patterns of irregularities, which are different from the pattern of irregularities of the longitudinally extending central portion of the material to be worked. Such patterns of irregularities are arranged in combination with the other pattern of irregularities. It is therefore possible to carry out an appropriate press forming on the elongated material to be worked to form the optimum patterns of irregularities serving as a heat transfer section. It is also possible to form heat transfer sections in which the heat exchanging capacity is optimized, on the longitudinally extending opposite edge portions having required conditions, which are different from the longitudinally extending central portion. Continuous forming steps can also be carried out with the use of the press-forming devices as arranged, thus improving remarkably the forming operation efficiency.

According to the features of the third aspect of the present invention, the flange portions are formed on the longitudinally extending opposite edge portions of the material to be worked, by means of the press-forming device, thus imparting a prescribed bending strength in the longitudinal direction to the material to be worked. Accordingly, even when the material to be worked is elongated, it does not easily bend. It is therefore possible to maintain properly the shape of the material as worked to facilitate the subsequent steps and increase the strength of the heat transfer member.

According to the features of the fourth aspect of the present invention, the flat portions and the recess portions or the projection portions are formed on the longitudinally extending opposite edge portions of the material to be worked, by means of the press-forming device so that the flat portions serve as an area to which a subsequent connecting step is to be applied. When the material to be worked, which has been subjected to the press forming, is finally welded to the other material to be worked to form a heat transfer member, it is possible to utilize the flat portions as the area to which the welding step is to be applied, facilitating a welding operation. In addition, the material to be worked can be held by clamping the flat portions from opposite sides of the material to be worked in its transverse direction, thus providing an easy conveying operation of the material to be worked. Further, forming the recess portions or the projection portions on the flat portions of the material to be worked imparts the bending strength in the transverse direction to the material to be worked. Accordingly, the flat portions do not easily bend in the transverse direction of the material to be worked so as to prevent the material to be worked from bending in the transverse direction when holding it, while clamping the flat portions thereof.

According to the features of the fifth aspect of the present invention, an image of the material to be worked is previously captured by means of an imaging device, prior to the press forming, so as to check the existence of defects on the surface of the material to be worked, and in case where any defects exist, the material to be worked, from which the portion having the defects has been removed, is fed to the press-forming device in a free state of defects. It is therefore possible to avoid problems that the defects are recognized after press-forming the material to be worked by means of the press-forming device and such a press-formed material is identified as an improperly finished product, resulting in waste of the material to be worked. Feeding the material to be worked, from which the portion having the defects has been removed in a reliable manner, to the press-forming device makes it possible to prevent the defects from being erroneously left on the heat transfer member after the press forming thereof, thus ensuring safety.

According to the features of the sixth aspect of the present invention, the marks for defining the positions of the material to be worked to which the press forming is to be applied, are previously put by means of the marking device, prior to the press forming. While detecting the marks by means of the mark detection device of the press-forming device, the press forming is applied to the material to be worked, in accordance with the marks as put so that the patterns of irregularities are formed on the portions of the material to be worked, on which the marks are put. It is therefore possible to carry out the press forming on the appropriate positions of the material to be worked, while obtaining information on the positions to which the press forming is to be applied, so as to make a precise positional adjustment for the press forming, thus improving accuracy of the shape of the heat transfer member as manufactured.

What is claimed is:

1. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provided with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the step of:

forming flat portions having a prescribed width on longitudinally extending opposite edge portions of the material to be worked so as to make a difference in level from a longitudinally extending central portion thereof, as well as forming any set of prescribed recess portions and prescribed projection portions on said flat portions at prescribed intervals in the longitudinal direction of the material to be worked, utilizing said press-forming device.

2. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provided with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the steps of:

detecting, prior to the press forming of said material to be worked utilizing said press-forming device, any one of surface condition and internal structure of said material to be worked utilizing a detection device to obtain detection data;

analyzing said detection data utilizing a data analyzing device to judge existence of defects on any one of a surface and an inside of said material to be worked; and in case where there is made a judgment that the defects exist on said material to be worked, stopping a feeding operation of the material to b worked to the press-forming device, removing respective portions having the defects from a downstream side and a upstream side of said defects of the material to be worked, and then feeding the material to be worked to the press-forming device, while detecting new defects after said defects in the feeding direction of the material to be worked utilizing said detection device.

3. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provided with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the steps of:

putting, prior to the press forming of said material to be worked utilizing said press-forming device, a plurality of marks for defining prescribed positions of the material to be worked to which the press forming is to be applied, on a surface of the material to be worked at prescribed intervals in the longitudinal direction of the material to be worked, utilizing a marking device; and conducting the press forming on the prescribed positions of the material to be worked, which are defined by said marks, utilizing said press-forming device, when said marks of the material to be worked, which is fed in the single feeding direction, are detected by means of a mark detection device.

4. The method as claimed in claim 3, further comprising the steps of: putting the marks on the surface of the material to be worked in the feeding direction utilizing the marking device;

performing an arithmetic operation of an imaginary central line connecting the marks as put;

successively extending said imaginary central line to obtain an extended central line; and successively putting the marks on said extended central line at prescribed intervals in the longitudinal direction of the material to be worked.

5. The method as claimed in claim 3, further comprising the steps of:

defining at least one set of imaginary central points and imaginary edge side points, which are placed on opposite sides of said imaginary central point by a prescribed distance, on the surface of said material to be worked;

measuring an edge distance from any one of the imaginary central point and the imaginary edge side points to a side edge of said material to be worked, which are set successively in the feeding direction of said material to be worked; and putting the marks on the surface of the material to be worked in the feeding direction on a basis of an amount of variation of said edge distance thus measured, utilizing said marking device.

6. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provided with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the steps of:

forming flange portions on longitudinal extending opposite edge portions of the material to be worked so as to make a difference in level from a longitudinally extending central portion thereof, utilizing said press-forming device; and forming flat portions having a prescribed width on longitudinally extending opposite edge portions of the material to be worked so as to make a difference in level from a longitudinally extending central portion thereof, as well as forming any set of prescribed recess portions and prescribed projection portions on said flat portions at prescribed intervals in the longitudinal direction of the material to be worked, utilizing said press-forming device.

7. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provide with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the steps of:

forming flange portions on longitudinally extending opposite edge portions of the material to be worked so as to make a difference in level from a longitudinally extending central portion thereof, utilizing said press-forming device;

detecting, prior to the press forming of said material to be worked utilizing said press-forming device, any one of surface condition and internal structure of said material to be worked utilizing a detection device to obtain detection data;

analyzing said detection data utilizing a data analyzing device to judge existence of defects on any one of a surface and an inside of said material to be worked; and in case where there is made a judgment that the defects exist on said material to be worked, stopping a feeding operation of the material to be worked to the press-forming device, removing respective portions having the defects from a downstream side and a upstream side of said defects of the material to be worked, and then feeding the material to be worked to the press-forming device, while detecting new defects after said defects in the feeding direction of the material to be worked utilizing said detection device.

8. The method as claimed in claim 1, further comprising the steps of:

detecting, prior to the press forming of said material to be worked utilizing said press-forming device, any one of surface condition and internal structure of said material to be worked utilizing a detection device to obtain detection data;

analyzing said detection data utilizing a data analyzing device to judge existence of defects on any one of a surface and an inside of said material to be worked; and in case where there is made a judgment that the defects exist on said material to be worked, stopping a feeding operation of the material to be worked to the press-forming device, removing respective portions having the defects from a downstream side and a upstream side of said defects of the material to be worked, and then feeding the material to be worked to the press-forming device, while detecting new defects after said defects in the feeding direction of the material to be worked utilizing said detection device.

9. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provided with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the steps of:

forming flange portions on longitudinally extending opposite edge portions of the material to be worked so as to make a difference in level from a longitudinally extending central portion thereof, utilizing said press-forming device;

putting, prior to the press forming of said material to be worked utilizing said press-forming device, a plurality of marks for defining prescribed positions of the material to be worked to which the press forming is to be applied, on a surface of the material to be worked at prescribed intervals in the longitudinal, direction of the material to be worked, utilizing a marking device; and conducting the press forming on the prescribed positions of the material to be worked, which are defined by said marks, utilizing said press-forming device, when said marks of the material to be worked, which is fed in the single feeding direction, are detected by means of a mark detection device.

10. The method as claimed in claim 1, further comprising the steps of:

putting, prior to the press forming of said material to be worked utilizing said press-forming device, a plurality of marks for defining prescribed positions of the material to be worked to which the press forming is to be applied, on a surface of the material to be worked at prescribed intervals in the longitudinal direction of the material to be worked, utilizing a marking device; and conducting the press forming on the prescribed positions of the material to be worked, which are defined by said marks, utilizing said press-forming device, when said marks of the material to be worked, which is fed in the single feeding direction, are detected by means of a mark detection device.

11. The method as claimed in claim 2, further comprising the steps of:

putting, prior to the press forming of said material to be worked utilizing said press-forming device, a plurality of marks for defining prescribed positions of the material to be worked to which the press forming is to be applied, on a surface of the material to be worked at prescribed intervals in the longitudinal direction of the material to be worked, utilizing a marking device; and conducting the press forming on the prescribed positions of the material to be worked, which are defined by said marks, utilizing said press-forming device, when said marks of the material to be worked, which is fed in the single feeding direction, are detected by means of a mark detection device.

12. A method for manufacturing a heat transfer member comprising the steps of:

subjecting material to be worked, which is made of a metallic thin sheet, to a press forming utilizing upper and lower molds of a press-forming device to form said material to be worked into a shape having prescribed irregularities, thereby preparing a heat transfer member for a heat exchanger, wherein:

an elongated material is used as said material to be worked;

a press-forming device is provide with molds each having a length shorter than said elongated material to be worked; and said press forming is carried out by press-forming, while feeding said elongated material to be worked in a single feeding direction in parallel with a longitudinal direction of said elongated material to be worked, said elongated material to be worked on prescribed portions thereof, which have been previously set so as to be placed at prescribed intervals in the longitudinal direction of said elongated material to be worked, utilizing said press-forming device, thereby preparing the heat transfer member having a plurality of patterns of irregularities, which are arranged in the longitudinal direction of said elongated material to be worked;

said method further comprising the steps of:

forming flange portions on longitudinally extending opposite edge portions of the material to be worked so as to make a difference in level from a longitudinally extending central portion thereof, utilizing said press-forming device;

putting marks on the surface of the material to be worked in the feeding direction utilizing marking device;

performing an arithmetic operation of an imaginary central line connecting the marks as put;

successively extending said imaginary central line to obtain an extended central line; and successively putting the marks on said extended central line at prescribed intervals in the longitudinal direction of the material to be worked.

13. The method as claimed in claim 10, further comprising the steps of:

putting the marks on the surface of the material to be worked in the feeding direction utilizing the marking device;

performing an arithmetic operation of an imaginary central line connecting the marks as put;

successively extending said imaginary central line to obtain an extended central line; and successively putting the marks on said extended central line at prescribed intervals in the longitudinal direction of the material to be worked.

14. The method as claimed in claim 11, further comprising the steps of:

putting the marks on the surface of the material to be worked in the feeding direction utilizing the marking device;

performing an arithmetic operation of an imaginary central line connecting the marks as put;

successively extending said imaginary central line to obtain an extended central line; and successively putting the marks on said extended central line at prescribed intervals in the longitudinal direction of the material to be worked.

15. The method as claimed in claim 4, further comprising the steps of:

defining at least one set of imaginary central points and imaginary edge side points, which are placed on opposite sides of said imaginary central point by a prescribed distance, on the surface of said material to be worked;

measuring an edge distance from any one of the imaginary central point and the imaginary edge side points to a side edge of said material to be worked, which are set successively in the feeding direction of said material to be worked; and putting the marks on the surface of the material to be worked in the feeding direction on a basis of an amount of variation of said edge distance thus measured, utilizing said marking device.

16. The method as claimed in any one of claims 4 to 15, wherein:

a plurality of additional press-forming devices each being provided with molds having a length shorter than said elongated material to be worked are provided so as to be arranged in a feeding direction of said elongated material to be worked on upstream and downstream sides of said press-forming device; and a press-forming is applied, before and after the press forming on the portions of the elongated material to be worked utilizing said press-forming device, to both prescribed regions on one longitudinally extending side edge portion of the elongated material to be worked and prescribed regions on an other longitudinally extending side edge portion thereof utilizing any one of said additional press-forming devices, thereby preparing the heat transfer member having at least two kinds of patterns of irregularities, which are arranged in the longitudinal direction of said elongated material to be worked.

* * * * *